US005846005A

United States Patent [19]

Britz et al.

[11] Patent Number: 5,846,005

[45] **Date of Patent: *Dec. 8, 1998**

[54] LABEL PRINTER WITH CUTTER ATTACHMENT

[75] Inventors: Todd A. Britz, Lakeville; Michael R. Tolrud, Chaska, both of Minn.

[73] Assignee: Primera Technology, Inc., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 709,689

[22] Filed: Sep. 9, 1996

[51] Int. Cl.[6] ..... B41J 11/66

[52] U.S. Cl. ..... 400/621; 400/621.1; 400/645; 101/288; 346/24

[58] Field of Search ..... 400/621, 621.1, 400/636, 644, 645, 645.2, 645.3; 101/288; 83/443, 747; 346/24

[56] References Cited

U.S. PATENT DOCUMENTS

| | | | |
|---|---|---|---|
| 3,334,895 | 8/1967 | Daniels et al. | 271/68 |
| 3,548,699 | 12/1970 | Gerber et al. | 83/528 |
| 3,650,448 | 3/1972 | Jarmy | 226/45 |
| 3,761,950 | 9/1973 | Yeiser | 346/68 |
| 3,772,949 | 11/1973 | Pavone et al. | 83/56 |
| 4,216,482 | 8/1980 | Mason | 346/129 |
| 4,384,298 | 5/1983 | LaBarre et al. | 346/129 |
| 4,437,780 | 3/1984 | Weber et al. | 400/645.3 |
| 4,467,525 | 8/1984 | Logan et al. | 33/18 B |
| 4,608,891 | 9/1986 | Frisby et al. | 83/56 |
| 4,838,719 | 6/1989 | Une | 400/618 |
| 4,841,822 | 6/1989 | Gerber | 83/174 |
| 4,879,935 | 11/1989 | Gerber | 83/478 |
| 4,918,461 | 4/1990 | Murakami | 400/621.1 |
| 5,041,845 | 8/1991 | Ohkubo et al. | 346/24 |
| 5,074,178 | 12/1991 | Shetley et al. | 83/47 |
| 5,094,134 | 3/1992 | Mizukoshi | 83/700 |
| 5,226,743 | 7/1993 | Jackson et al. | 400/625 |
| 5,261,754 | 11/1993 | Sugiura | 400/636 |
| 5,271,789 | 12/1993 | Takagi et al. | 400/621 |
| 5,288,358 | 2/1994 | Logan | 156/268 |
| 5,296,872 | 3/1994 | Caamano | 346/24 |
| 5,297,871 | 3/1994 | Fujioka | 400/636 |
| 5,323,182 | 6/1994 | Suzuki | 346/24 |
| 5,427,462 | 6/1995 | Jackson et al. | 400/579 |
| 5,481,969 | 1/1996 | Beck et al. | 101/389.1 |
| 5,524,996 | 6/1996 | Carpenter et al. | 400/621 |
| 5,553,528 | 9/1996 | Zoltner | 83/443 |

FOREIGN PATENT DOCUMENTS

| | | |
|---|---|---|
| 0 607 539 A2 | 7/1994 | European Pat. Off. . |
| 726168 | 3/1955 | United Kingdom . |

*Primary Examiner*—Christopher A. Bennett
*Attorney, Agent, or Firm*—Westman, Champlin & Kelly, P. A.

[57] ABSTRACT

A label printer and cutter combination will print a number of labels on a large sheet that is fed from a sheet tray coupled to the printer. The labels are oriented orthogonally along X–Y axes on the sheet, and once all the labels on the sheet have been printed, a transfer section coupled to the printer changes position and the sheet is fed, with the printed labels on the sheet, into a cutter. The cutter is operated to individually cut the labels and deposit the sheet of properly cut labels onto a storage tray. The printer and the cutter are operated under digital control and can be programmed to accommodate different size labels as well as different size sheets as well as provide signals for controlling related functions of the printer and cutter.

19 Claims, 11 Drawing Sheets

LABEL PRINTER WITH CUTTER ATTACHMENT

BACKGROUND OF THE INVENTION

The present invention relates to a label printer that will print one or more labels onto a sheet, and operate to transfer this sheet directly to a cutter forming part of the assembly for cutting the individual labels from the sheet.

Digitally controlled cutters have been known in the prior art, and used with various preprinted sheets of labels separately from the printer. Also, label printers of various designs that will print multiple colored labels onto a sheet are known. Combined platens and cutters are also known. The present invention relates to a system which combines the features of a label printer and cutter into a single frame using a sheet transfer section between the label printer and the cutter.

SUMMARY OF THE INVENTION

The present invention relates to a combination label printer that will print a plurality of labels onto a single large sheet, and transfer the labels to an implement such as a cutter mounted on the same frame for performing operations, such as cutting the individual labels to separate them from each other. The printer is a digital label press that utilizes a graphics art or imaging digital program to control a multicolored printer to print one or more labels onto a sheet and index them appropriately relative to an indexing mark that is printed by the printer on the sheet. The printer construction and operation for printing labels is known. The labels can be printed in black and white or color.

The printer feeds the paper from a paper storage tray, and after the printing of the labels is finished, the controls will shift a sheet transfer section to cause the printer to feed the sheet with the printed labels, into the feed rollers for the secondary operation, shown as a cutter, and the cut vectors are then controlled from the main program so that the cutter will cut out the individual labels. If the secondary operation is adding a detail to the printed sheet, the cutter knife can be replaced with a pen, a tool that applied an overlay stripe or the like. The description will talk specifically about a cutter.

The sheet generally has multiple layers of paper or backing material, with the outer layer on which the labels are printed having an adhesive back so that the labels can be sliced in a manner so that they can be removed and applied to any desired substrate.

While various computerized programs can be used for controlling the printer and the cutter, a cutter control file is used for laying out the periphery of a desired number of labels on a standard sheet, for example a sheet 12×17 inches, and the cutter path around each label is also determined by inputting cut vectors for controlling the orthogonal movement of the cutter (laterally) and printed sheet (longitudinally).

A controller receives both the label printing pattern to reproduce the desired images, and the label cut vectors for the particular sheet of labels being made. Once the program has started, the printer control information from a print file is directed to the print controller and after that information has been transferred, the cutter controller stores, all of the cut vectors for a sheet relative to a reference mark, printed as a first step in printing the labels. The printed reference is made under the same program as the rest of the printing so the reference mark is precisely printed relative to the particular label images on the sheet.

After an initial sheet is printed, the printing information is sent to the printer sequentially after a signal is provided to indicate that the previously printed sheet has been loaded into the cutter. This allows the printer and cutter to run simultaneously, that is one sheet is being printed while the labels on the previous sheet are being cut.

The printer controller will cause the sheet to be loaded with a known paper feed from a sheet storage tray of conventional design. As the sheet is fed in, the printer has sensors to measure the paper length as soon as the image printing data has been received from the print file. The print head that receives the image data prints in a conventional manner. Horizontal and vertical indexing lines (lateral and longitudinal) are printed first in a leading or front corner of the sheet. The indexing lines form a cutter target at the leading or front end of the sheet being printed. The indexing marks can be of any desired form, and can even be a corner of the first label or a separate indexing label if desired. The sheet is fed back and forth, as the labels are printed, along a path which includes trays supporting the sheet during feeding.

The sheet length information that was previously recorded when the sheet was first fed to the printer is sent to the cutter controller and when the printing of the sheet is complete, a signal indicating that the print controller is ready to feed the printed sheet to the cutter is provided.

The printer sheet drive moves the completed, printed sheet forward after a paper diverter has been shifted so the sheet is diverted from its normal path toward the input sides of feed rollers of a cutter. Once the diverter mechanism is in its cutter loading position, the cutter paper feed rollers are driven to pick up the sheet as the printer feed and indexing rollers move the sheet into the cutter feeder.

When the trailing or rear edge of the sheet is clear of the printer sheet indexing roller, the roller is no longer powered. The cutter index and feed rollers will then cause the entire length of the printed sheet to be moved toward a storage tray, until the trailing edge reaches the cutter feed roller, the paper diverter will then move to its original position and then the cutter index and feed rollers will reverse the direction of movement of the printed sheet and feed the paper away from the storage tray and onto an eject tray. The reverse sheet feed continues until the front edge of the sheet is again detected. It is the edge adjacent the index mark or target that had been printed during the printing operation.

When the sheet diverter is returned to its original position the sheet in the cutter moves into the eject tray when reversed in movement and a new sheet can be fed from the supply into the printer. The printer starts its printing cycle by feeding the new sheet from the supply tray. The sheet with the printed labels in the cutter feed rollers is again reversed in direction and fed from the eject tray toward the cutter knife until the horizontal or lateral index target line is detected by an indexing sensor. Then the cutter blade and indexing sensor is moved horizontally until the vertical or longitudinal index target line is detected. The reference position is then known and stored in memory and the controller uses the information to index the cutter. The cutter and sheet are then each moved in response to cut vectors for cutting the individual labels along orthogonal lines. Once the cutter has completed its program, the sheet with the separated labels is moved into the storage rack or tray. The sheet moves longitudinally, that is, parallel to its longitudinal length, for making the longitudinal cuts, and the cutter moves laterally or horizontally for the lateral cuts needed to form a rectilinear configuration of cut. The cutting blade is made so that it will swivel and follow the direction of relative movement between the cutter and the sheet. The blade swivels to cause the tapered sharp edge and point of the cutter blade to intercept the sheet so that the tapered sharp edge would face "upstream" relative to the direction of movement.

The common frame mounting the cutter with a paper diverter that diverts the paper from the printer to the cutter at appropriate times permits using a common tray having multiple support racks or pans for the sheets prior to printing, and during printing and cutting, and for the finished cut sheets.

The pressure on the cutter against the sheet is controlled by a unique arrangement for loading the cutter and also for controlling its movement away from the sheet for indexing movement. The printer indexing drive rollers and the cutter pressure and positioning drives use stepper motors that can be precisely, digitally controlled as to position. The cutter is lifted off the sheet at desired intervals. The indexing rollers used for the cutter are capable of maintaining a precise position of the sheet once it is fed into the cutter.

DETAILED DESCRIPTION OF THE PREFERRED EMBODIMENTS

Figure 1:
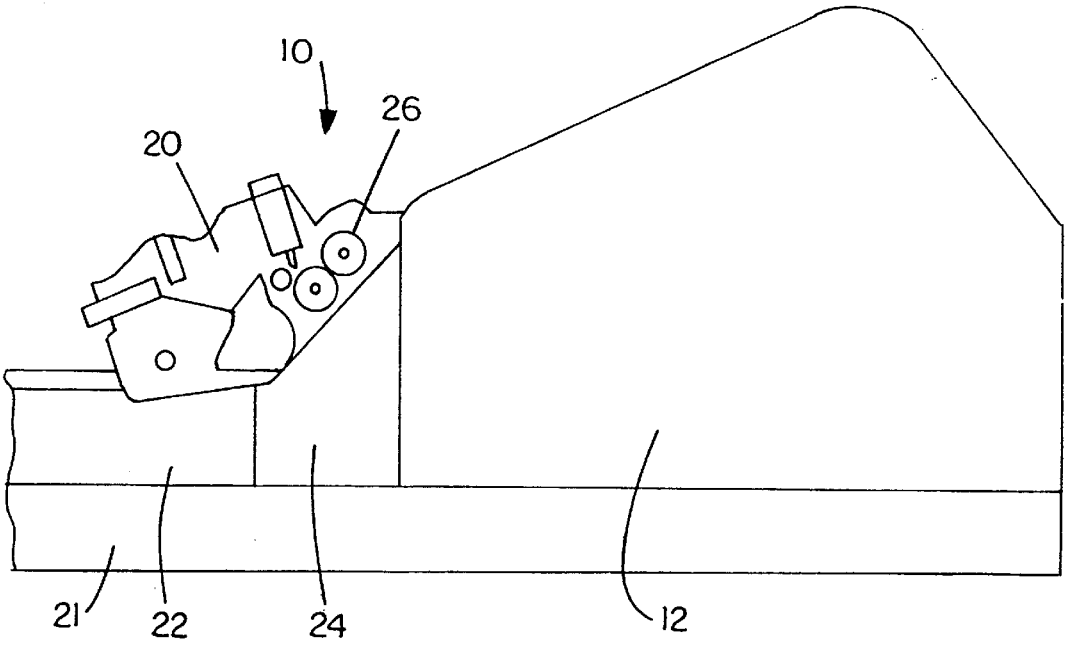
FIG. 1 is a schematic representation of a label printer and cutter assembly incorporating the features of the present invention.

Referring to FIG. 1, a combination label printer and cutter assembly indicated generally at 10 includes a label printer 12, which is digitally controlled to print a plurality of labels onto a sheet, so that there are as shown a plurality of horizontal rows or "ranks" and vertical columns or files of labels. The labels can be oriented in any desired manner on the sheet, even randomly. A printed sheet 46A is shown schematically in FIG. 1A and while only four columns or files of labels are shown, along with three rows or ranks, it can be seen that individual labels indicated at 14 are separated by horizontal or lateral cut lines 16 and vertical or longitudinally extending cut lines 18. If the labels are oriented differently on the sheet or have an irregular shape, the cut lines may be programmed as desired, even independently of the printed shape.

The assembly 10 includes a cutter assembly 20 that is mounted on the same or common frame 21 with the label printer and a sheet supply tray 22.

The sheet supply tray 22 is a sheet loading tray of substantially conventional form that utilizes a spring loaded sheet support plate, and a sheet feeder wheel which will lift off a top sheet and feed it into the label printer through a sheet transfer section 24. The sheet transfer section 24 permits the normal feeding and movement of sheets to the printer and the normal forward and reverse movement of the sheet during printing, but when printing is complete a plate in the sheet transfer section 24 is shifted in position so that the printer will drive the sheet through the transfer section to intercept the cutter feed and index rollers illustrated schematically at 26, forming part of the cutter assembly 20.

Figure 2:
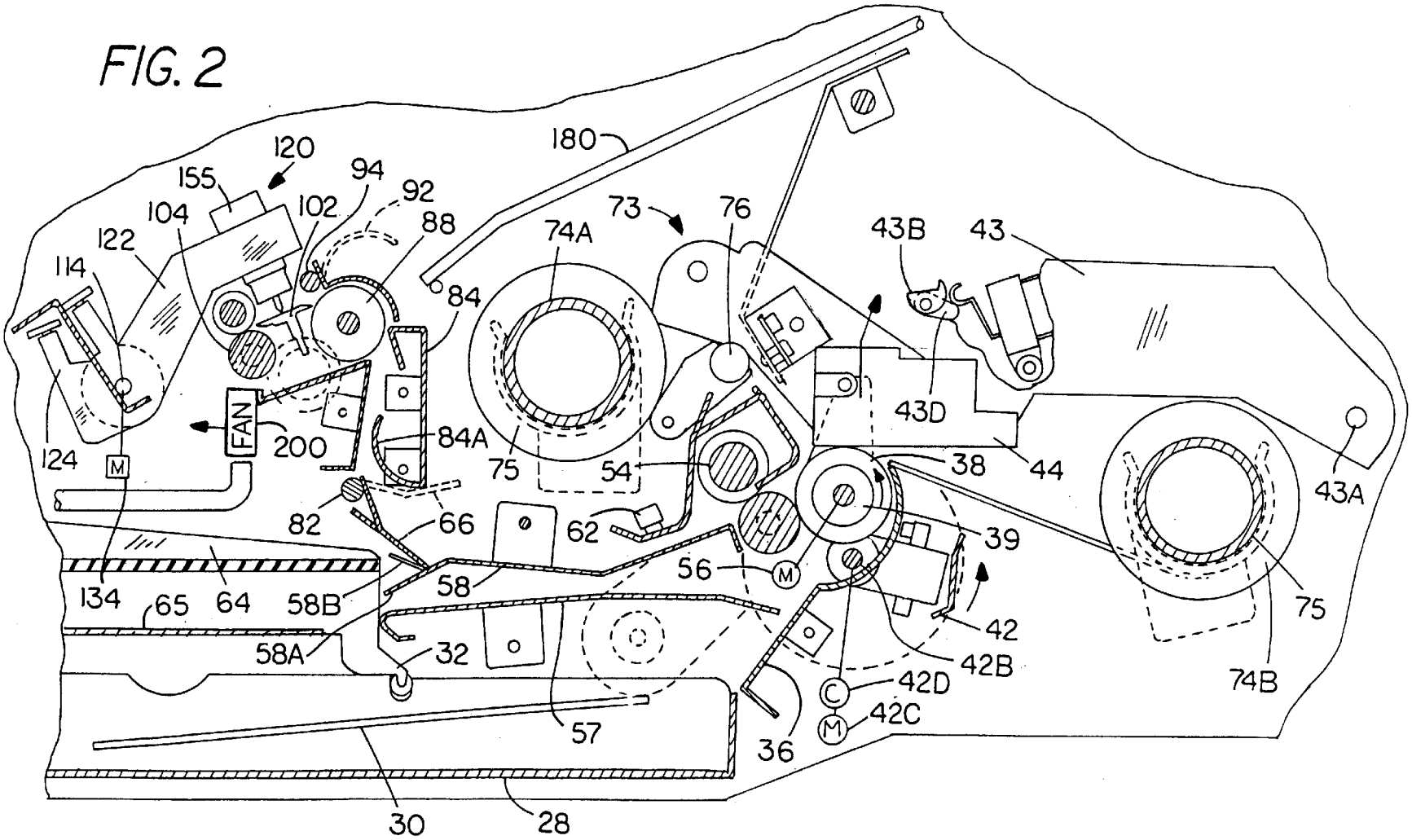
FIG. 2 is a partial side sectional view of the device of FIG. 1.
Figure 5:
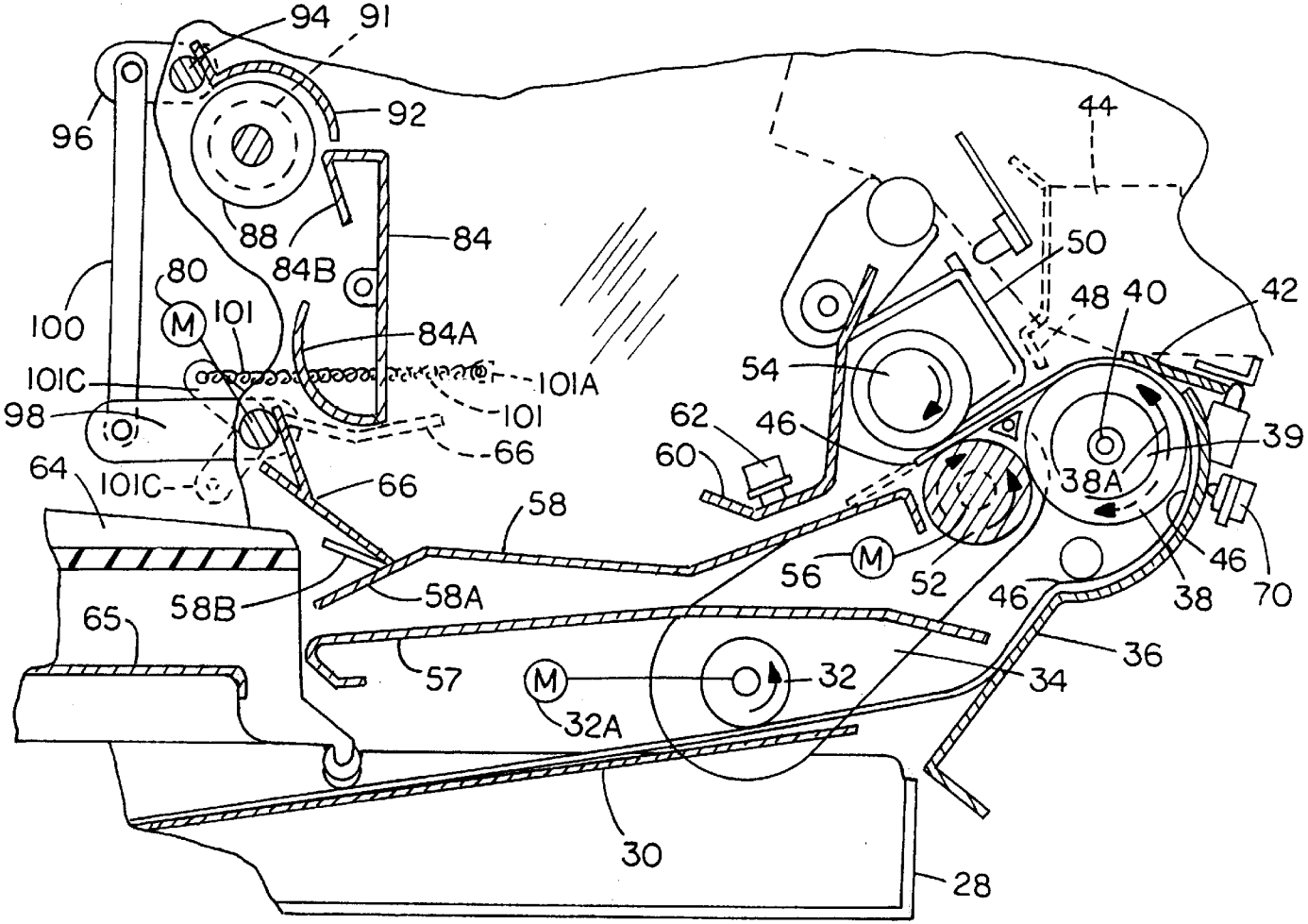
FIG. 5 is a further enlarged part sectional view of a sheet transfer section with parts in section and parts broken away, and illustrating the feed and indexing rollers utilized with the printer of the present invention.
Figure 6:
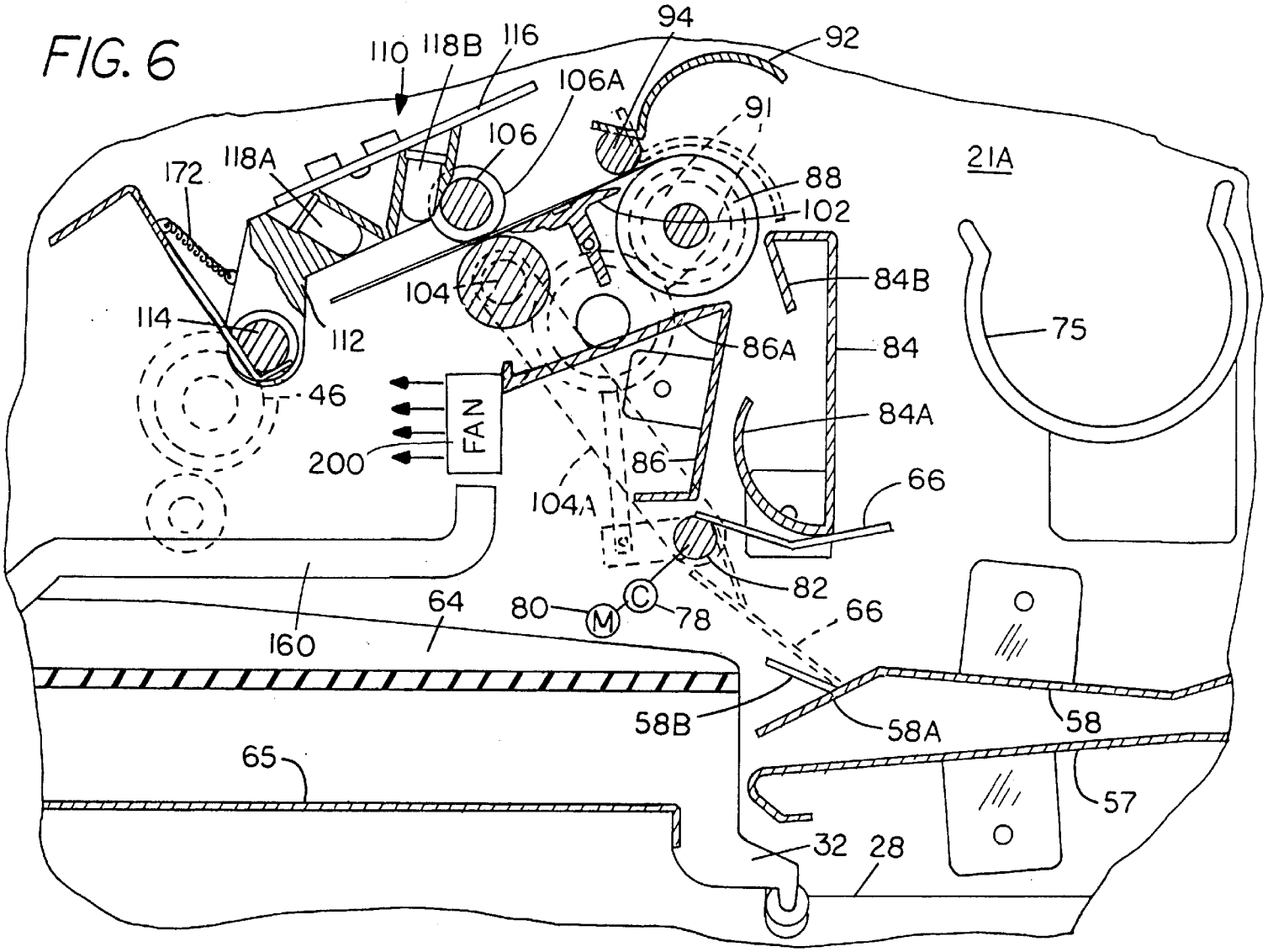
FIG. 6 is a fragmentary enlarged sectional view of a cutter feed assembly showing a sensor for sensing the indexing position of the printed sheet as it is initially fed into the cutter section.

Referring specifically to FIGS. 2, 5 and 6, the sheet supply tray 22 comprises an outer shell 28 of conventional design, and includes a spring loaded sheet support plate 30. The supply tray 22 is latched in place with a suitable latch mechanism 31 as is conventionally done. The supply tray 22 may be of any desired type presently known in the field.

A sheet feed drive roller 32 is mounted on a suitable arm 34 for pivoting down to engage a sheet on the spring loaded plate 30. The sheet feed roller 32 then moves a top sheet in a conventional manner and drives the sheet in direction as indicated by the arrow on roller 32 through the use of a suitable drive motor illustrated schematically at 32A. The motor 32A can be driven through an electric or other type of controllable clutch so that the motor 32A can be driven constantly when the printer is powered, but the roller 32 would only be driven when the clutch was energized. This can be precisely controlled through the input program. The sheet being fed will slide on a main guide plate 36, which as shown, is inclined upwardly in the printer, toward a printer platen 38. The platen is driven by a one-way clutch 39 from a center shaft 40 which in turn is driven by a belt 44 using conventional pulleys, from the shaft of a printer index roller 52. The platen 38 will free wheel when pulled in the direction of arrow 38A. For initial feeding the platen will be driven as indicated by the arrow 38A. Because of the one-way clutch 39 the platen 38 cannot be driven from shaft 40 in reverse direction. The frame 21 comprises a pair of spaced side plates 21A and 21B (FIG. 3) that are suitably supported together, and the frame houses the printer components and also supports a number of other components. A known print head 44 does the printing on a sheet illustrated at 46 when the printing is to occur and as the sheet passes back and forth over the platen 38. The print head 44 is mounted on a pair of spaced arms 43 that are pivoted as at 43A of the side plates of the frame (FIG. 2). The print head can be raised up from the platen 38 as indicated by the arrow in FIG. 2 by a conventional cam 43B driven from a central shaft. The print head is lifted at times during printing, such as when the paper is reversed. A microswitch 43C is actuated by a suitable cam 43D connected to move or rotate as the print head is lifted, to signal that the print head has been lifted so the sheet can be reversed.

Figure 8:
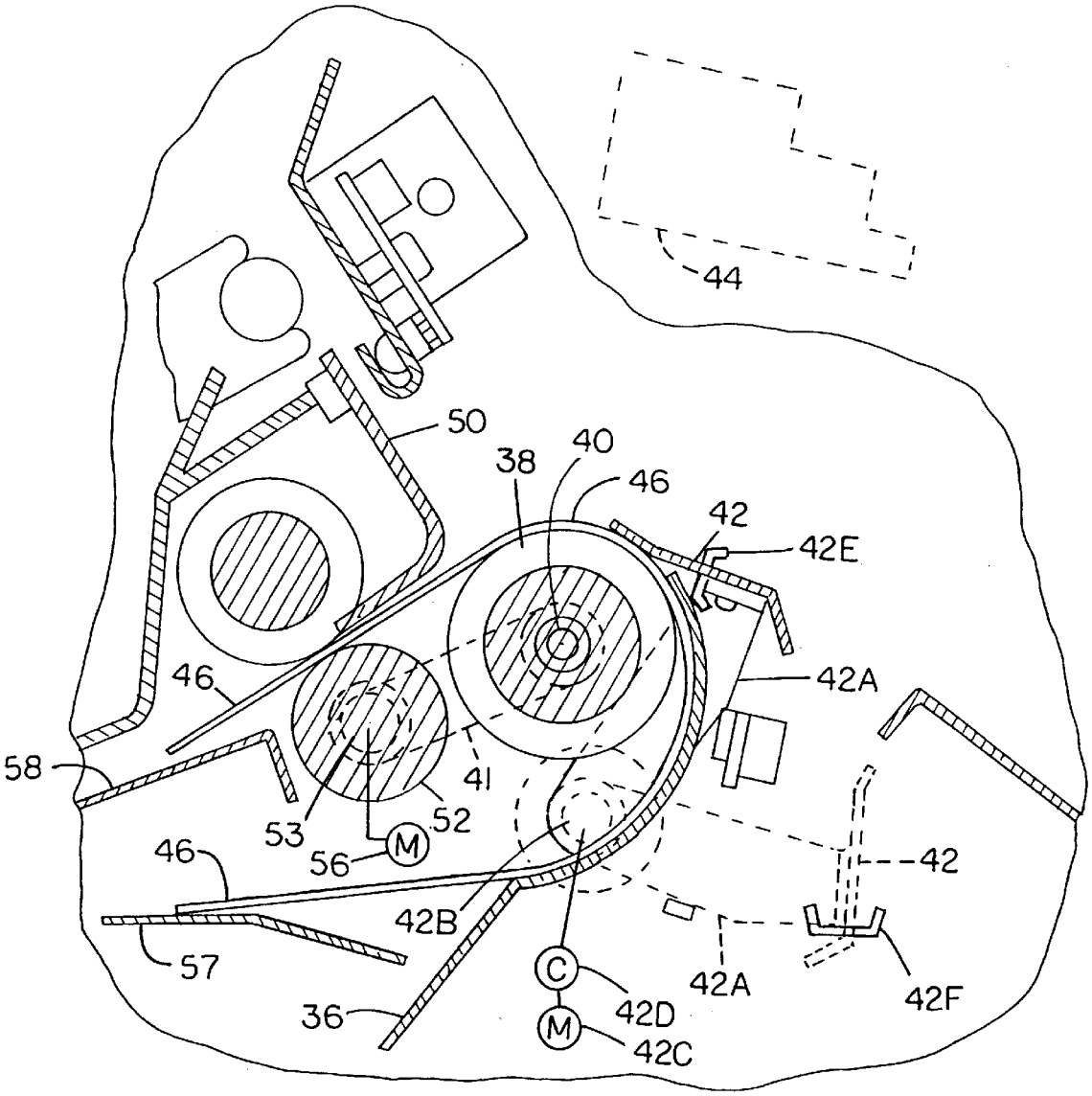
FIG. 8 is an enlarged side sectional view of the printer feed rollers and movable guide for paper reversal.
Figure 9:
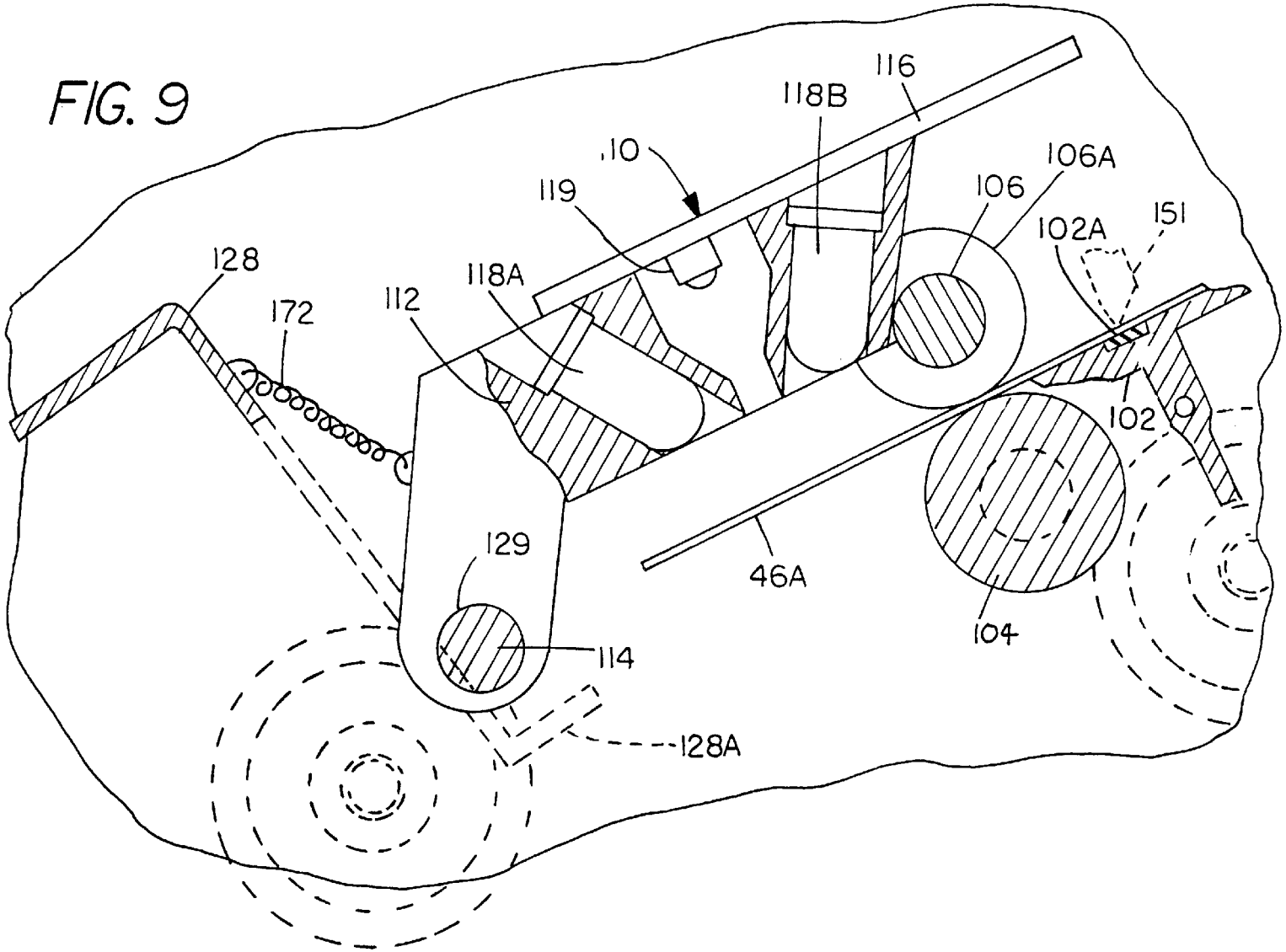
FIG. 9 is an enlarged side view of the sensor assembly shown in FIG. 7.

When the print head 44 is lifted from the platen 38 as shown in FIG. 8, and the sheet 46 is reversed (the platen 38 is free to rotate counter clockwise as when motor 56 is reversed) the sheet 46 is guided back along guide plate 36, by a reverse feed guide 42, which is moved to a position close to the platen. The reverse feed guide 42 is mounted on arms 42A that are in turn pivotally mounted on frame side plates 21A and 21B. A pivot shaft 42B is used, and can be driven by a motor 42C through a slip clutch 42D. The slip clutch will permit the arms 42A to move against stops 42E and 42F which stop the opposite directions of movement. The motor 42C is reversible and is controlled by the printing program to move the guide 42 to its solid line position in FIG. 8 when the print head 44 is lifted. Before the print head 44 moves to its usable position against the platen, the reverse feed guide 42 is moved to its dotted line position, clear of the sheet path.

As the sheet 46 is fed between the print head and the platen 38, it is guided by suitable guides mounted on the print head 42, such as guide 48, and a guide flange 50 that is mounted between the side plates 21A and 21B. The flange 50 guides the sheet to a printer indexing roller 52 that has a shaft 53 formed at its ends, the indexing roller is rotatably mounted on the frame, and is driven by a stepper motor 56. The shaft 53 has a sprocket which drives the belt 41 to drive the platen 38. A pinch roller 54 that is also rotatably mounted on the frame is spring loaded against the indexing roller 52 and provides a pressure to urge the sheet against knurled indexing sections at the ends of the printer indexing roller 52. The indexing roller is a precise or positive feed roller for the sheet.

The indexing roller 52 as stated is driven through the use of a stepper motor 56, and in the form shown, the belt and pulley 41 is selected so the indexing roller 52 rotates slightly faster than the platen 38, in order to insure that the sheet does not curl or lift from the platen surface when it is to be printed. The one-way clutch permits the platen to be pulled by the sheet and move slightly faster than it is being driven by its drive shaft.

The sheet is fed onto a further guide plate 58 as it exits the feed and indexing rollers of the printer that again is supported between the side plates 21A and 21B of the frame. The guide plate 58 is spaced from a support arm 60 that supports an optical sensor or other suitable sensor 62 that will sense the leading or front edge of the sheet 46 as it is being moved by indexing roller 52 on each pass.

The sheet length is enough so that the indexing roller 52 and spring loaded pinch roller 54 will be gripping the sheet so that the sheet 46 will be positively driven through its path.

The guide plate 58 extends back toward the sheet tray which has a support shelf 64 (FIG. 2) supported above the spring loaded plate 30 and shell 28. As shown in FIG. 6, a sheet scoop plate 66 is in its position shown in solid lines so that the sheet 46 moves along a lip 58B, and onto the shelf 64.

As the sheet is fed by the indexing roller 52, its front or leading edge is sensed by the sensor 62 as stated, and that information is provided back to the program control and stored until an end of paper sensor 70 (below platen 38) senses the trailing or rear end of the sheet 46 as it is fed through the printer on its initial pass. The length of the sheet 46 is measured by the sensors and the position information from stepper motor 56 and the sheet length is stored for use by the cutter control as well as for use in printing the labels.

Figure 1A:
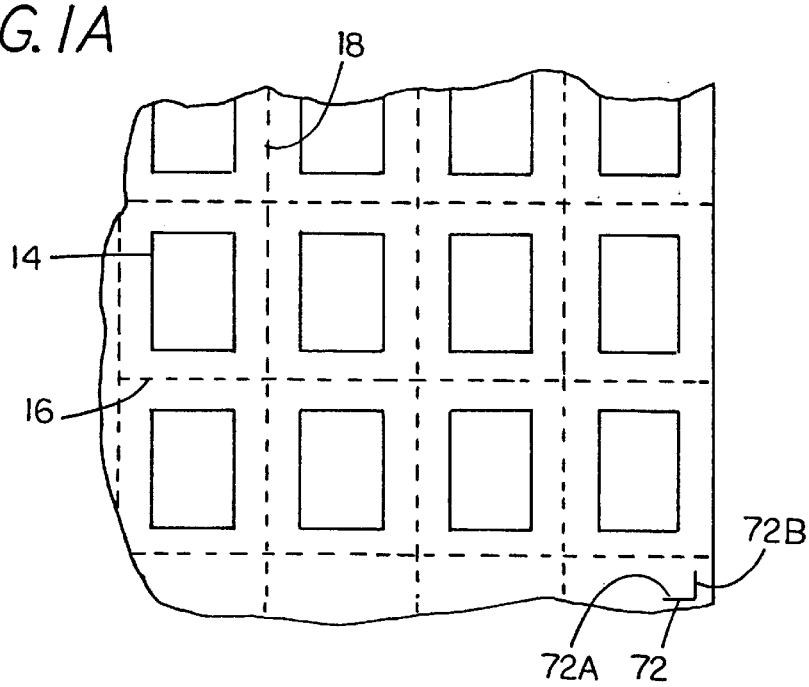
FIG. 1A is a partial schematic layout of a printer label sheet printed and cut by the assembly of FIG. 1.

When the initial feed of the sheet 46 is complete (the rear end is sensed) the drive to indexing roller 52 is reversed, and the paper is then fed back to a position wherein the front edge or leading edge of the sheet 46 is properly positioned relative to the print head 44, so that the printing operation can begin. The sheet feeds onto a guide plate or tray 57 and onto a plate 65 when reversed. The length of the sheet as stored in memory, is compared to the movement of the drive surface of indexing roller 52 in order to insure that the front edge of the sheet is in the correct position. After positioning, an indexing mark is first printed onto the sheet as shown in FIG. 1A at 72. The indexing mark includes two orthogonal lines including a lateral or horizontal line 72A and a vertical or longitudinal line 72B. These are at right angles to each other, and will serve as an index of the sheet relative to the individual labels 14. The ribbon supply can be a conventional type ribbon that can have a plurality of colors mounted in a ribbon cartridge 73, that will snap into place on support hubs that comprise a ribbon supply hub 74B and a ribbon take-up hub 74A. The holders 75 are of a conventional design that are mounted on the ribbon cartridge.

The ribbon cartridge can be put into place and removed when the printer head is manually moved out of the way. The printer can have suitable covers on it that would be removable or openable for handling the components.

This ribbon supply is shown only schematically, because it is conventional. Suitable ribbon guides such as that shown at 76 can be used for guiding the ribbon appropriately adjacent to the platen 38 and the print head 44.

The print head 44 is controlled by a program so that the labels will be printed individually on the sheet 46, within the borders provided and graphics that are inputted into the printer control will also be printed. The label sheet 46 will be moved forward and backward for printing as controlled by the indexing (feed) roller 52.

As the printing progresses, the index roller 52 and the pinch roller 54 feed the sheet back and forth until the printing is complete. The printed portion of the sheet is supported on the guide plate 58.

As the sheet continues to be printed toward its trailing or rear end, the sheet will be supported on the plate 64, and the guide plate 58. When the sheet is all printed, as indicated by the signals from the control section that senses the length of the sheet, and before the sheet moves out of the indexing roller 52 and pinch roller 54, the indexing roller 52 is reversed (after the print head 44 is raised) until the front or leading edge of the sheet 46 has moved past the end of the guide plate 58 so it is clear of the scoop plate 66. This position can be calculated so that it is known when the front edge of the fully printed sheet has moved sufficiently far rearwardly to be clear of the scoop plate 66.

At an appropriate time, a drive motor 80, driving a shaft 82 through an electric clutch 78 will be operated in a direction to move the scoop plate from its position shown in solid lines in FIG. 6 to the position shown in solid lines in FIGS. 2 and 5 with the edge of the scoop plate stopped against a stop lip 58B on the guide plate 58. The electric clutch 78 permits the scoop plate 66 to be stopped at its two positions against positive stops including the lip 58B and an end of a paper guide 84. The scoop plate 66, as will be explained, is in the two positions with a tension spring 101 on each side of the frame.

The scoop plate 66 is in its position shown in solid lines in FIG. 6 during the printing operation so that it is out of the way of the movement of the sheet along the guides 58 and onto the support shelf 64.

The diverter position of scoop plate 66 shown in solid lines in FIG. 5 is for a transfer of the printed sheet into the cutter section 20. The sheet is guided through a series of guides to the cutter section. One such guide plate 84, that has a lower curved section 84 provides a space adjacent the scoop plate 66 for directing the sheet upwardly between the plate 84 and a guide plate 86 (see FIG. 6).

FIG. 6 also illustrates a cutter feed roller 88 that has a shaft 90 driven by a gear set 91 from a shaft end of a cutter index roller 104. Gear set 91 is shown only in dotted lines (its on the outside of the frame plates). The cutter feed roller guide hood 92 is used adjacent the feed roller 88 for guiding the printed sheet into the cutter assembly 20. It should be noted that the guide plate 84 lower section 84A serves to initially guide the printed sheet relative to the plate 86. An upper section 84B of guide plate 84 guides the sheet moving along the surface of the plate 86 toward the feed roller 88 to a position underneath the cutter feed roller guide hood 92 when it is in its solid line position shown in FIG. 5, and the scoop plate 66 is shown also in the paper diverter position. The sheet guide plates are mounted to the frame side plates 21A and 21B, and extend between the side plates. Typical mounting tabs for the guide plates are shown schematically.

The guide hood 92 is mounted on a shaft 94 that is supported in suitable bearings on the frame side plates 21A and 21B. As shown in FIG. 5 a lever or cam member 96 is drivably connected to the shaft 94 on the outside of side plate 21A. The shaft 82 for the scoop plate 66 also has a lever 98 drivably connected thereto on the same side of the frame as the lever 96. A link 100 is pivotally mounted to the lever 98 at one end and is pivotally mounted to the lever 96 at the other end, so that when the shaft 82 is driven by the motor 80 to move the scoop plate 66 between its position shown in FIG. 6 in solid lines and the position shown in FIG. 5 in solid lines, the cutter feed roller guide hood 92 will also move between its solid line position shown in FIG. 5 and its solid line position shown in FIG. 6. The guide hood 92 lifts up out of the way of the feed roller, and will clear a sheet that is reverse driven through the cutter index and feed rollers, as will be explained.

The spring 101 is connected between lever 98 and the outer side of the side plate 21A as shown in FIG. 5, to hold the scoop plate 66 and the guide hood 92 in the respective positions. The spring 101 is fastened at 101A relative to the frame and at 101B to a lever arm 101C drivably mounted on shaft 82 so the spring 101 goes over center with respect to the axis of shaft 82 when the scoop plate 66 is shifted between its positions. This biases the scoop plate and guide hood to their positions and holds them positively when the electric clutch 78 is released.

A sheet moved by the rotating cutter feed roller 88, as guided by the guide hood 92, will pass over a cutting knife anvil 102 that is supported on the side frame members 21A and 21B, and which will provide a support for the sheet in alignment with a cutter knife operated in accordance with the preprogrammed control for slitting the printed labels in an appropriate manner. The sheet engages and is driven by a cutter indexing roller 104 that has end sections that are knurled for driving the printed sheet in a positive manner, and which index the sheet in a positive manner for driving the sheet in two directions. The paper feed roller 88 is driven by the gear set 91 from indexing roller 104 at a selected speed to insure that the paper does not bunch. The cutter feed roller 88 provides a friction drive to the sheet. It is covered with a urethane selected to have the desired friction characteristics.

Figure 6A:
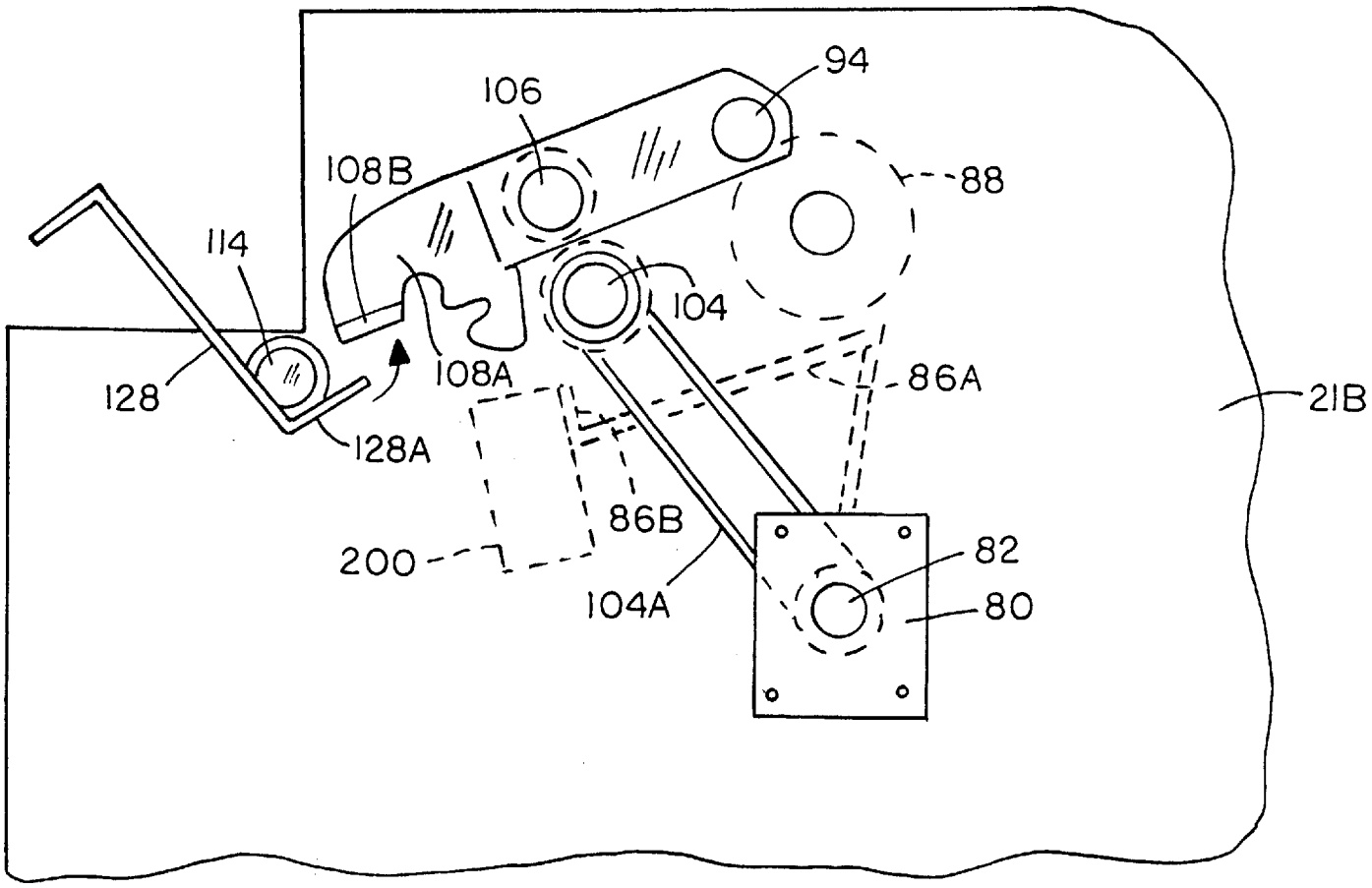
FIG. 6A is a view showing a support for a pinch roller which permits lifting the pinch roller from an indexing roller during loading of the cutter.

A pinch roller 106 runs on the top of the sheet shown at 46A, which is the sheet 46 after it has been printed, and provides pressure to cause the drive ends of the indexing roller 104 to engage the sheet positively. As shown schematically in FIG. 6A, the pinch roller 106 is rotatably mounted on a pair of arms 106C pivoted on the shaft 94 outside of the side plates 21A and 21B of the frame at pivots 108. The arms 108 are spring loaded with springs 106D toward the indexing roller 104. The pinch roller 106 has silicone or other polymeric material on the ends overlying the drive section of the cutter indexing roller 104. The main portions of the pinch roller 106 thus are smooth shaft portions of smaller diameter than the polymeric sections. The cutter indexing roller 104 is driven from a belt 104A shown in FIG. 6A from stepper motor 80 and controlled by the central control. As will be explained, the pinch roller 106 can be moved away from the indexing roller 104 to permit the sheet to lay flat and straight before it is clamped by the pinch rollers. The ends 108A of the arms 106C opposite the pivots on shaft 94 have lateral tabs 108B which are in registry with and may be engaged by actuator tabs 128A on a control plate 128, as will be explained.

As shown in FIG. 6, an optical sensor assembly 110 is mounted on an arm 112 that in turn is rotatably coupled to a cross shaft 114. The cross shaft 114 is used for not only supporting the arm 112, which in turn supports the sensor 110, but also will support an arm carrying the knife that will slit the sheet to form labels. The axis of shaft 114 lies along the plane tangent to cutter feed roller 88 and cutter indexing roller 104. This also is the plane of sheet 46A as it exits these rollers. The sensor assembly 110 includes a circuit board 116 that is mounted on the arm 112, and a pair of LED's 118A and 118B of different frequencies to permit detecting different colors that are mounted so that they will have focus lines represented as the central axis line of the lights intercepting the upper surface of the paper sheet 46A as it is fed through the index roller 104 and the pinch roller 106. A forward optical sensor 119, which senses a broad range of frequencies, senses light intensity and is mounted on the circuit board 116. This optical sensor 119 has a central axis that also coincides with the convergence point of the LED's 118A and 188B. When the end, called the front end, of the printed sheet 46A passes under the center line of the optical sensor 119, the state of the light changes because of the reflectivity of the sheet 46A and this will provide a signal indicating the front edge of the sheet 46A has reached that position. This signal is used for controlling the cutter assembly and can be used to indicate that the sheet is entering the cutter or that the sheet is exiting the cutter in reverse direction.

Signals from the sensor assembly 110 are sent to the control circuitry for controlling the cutter, and for controlling the cutter indexing and feed rollers, as well as for controlling the printer, so that it is known that the sheet 46A that has been printed has entered the cutter assembly.

Figure 4:
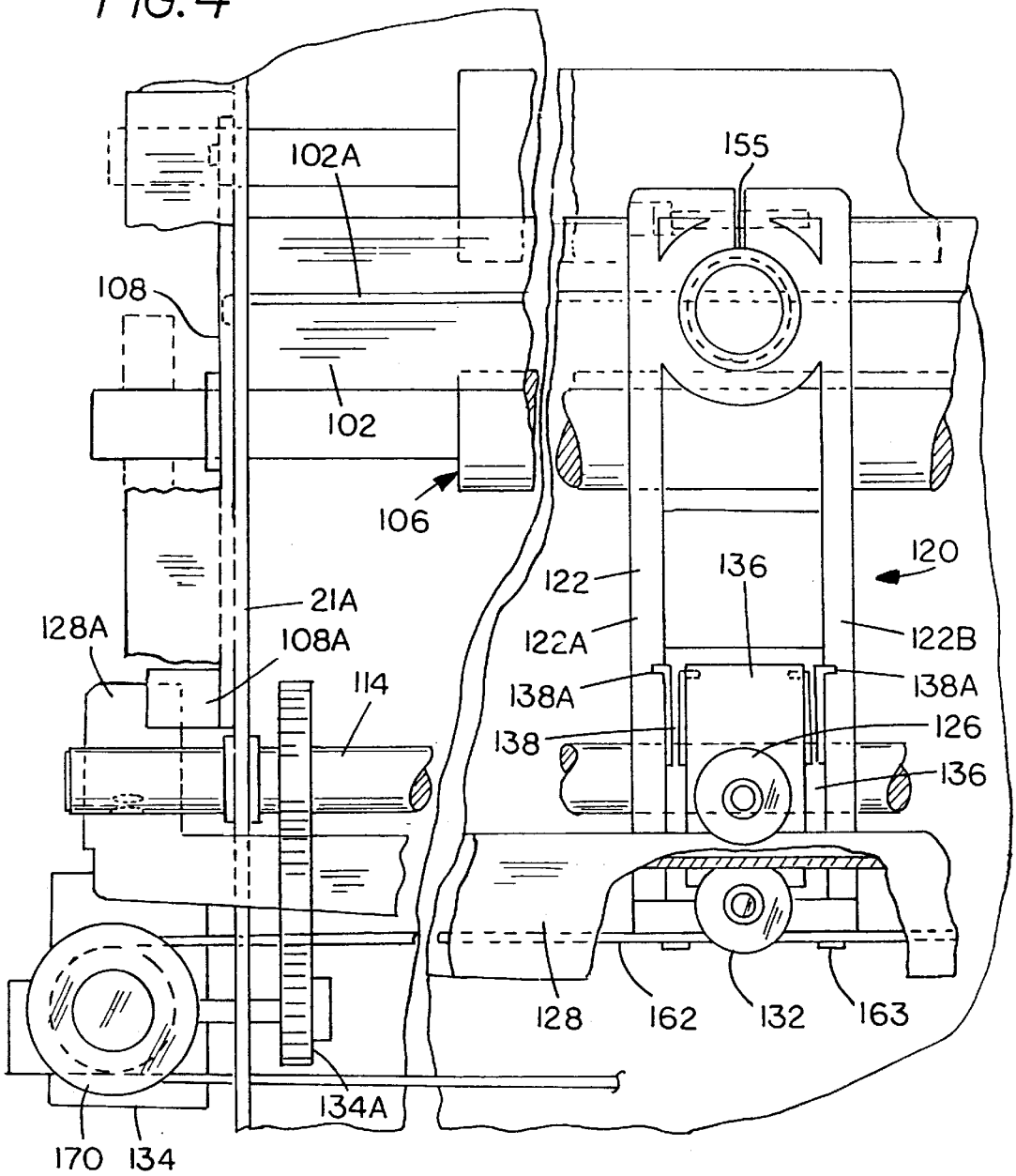
FIG. 4 is an enlarged top view of the cutter assembly with parts in section and parts broken away.
Figure 7:
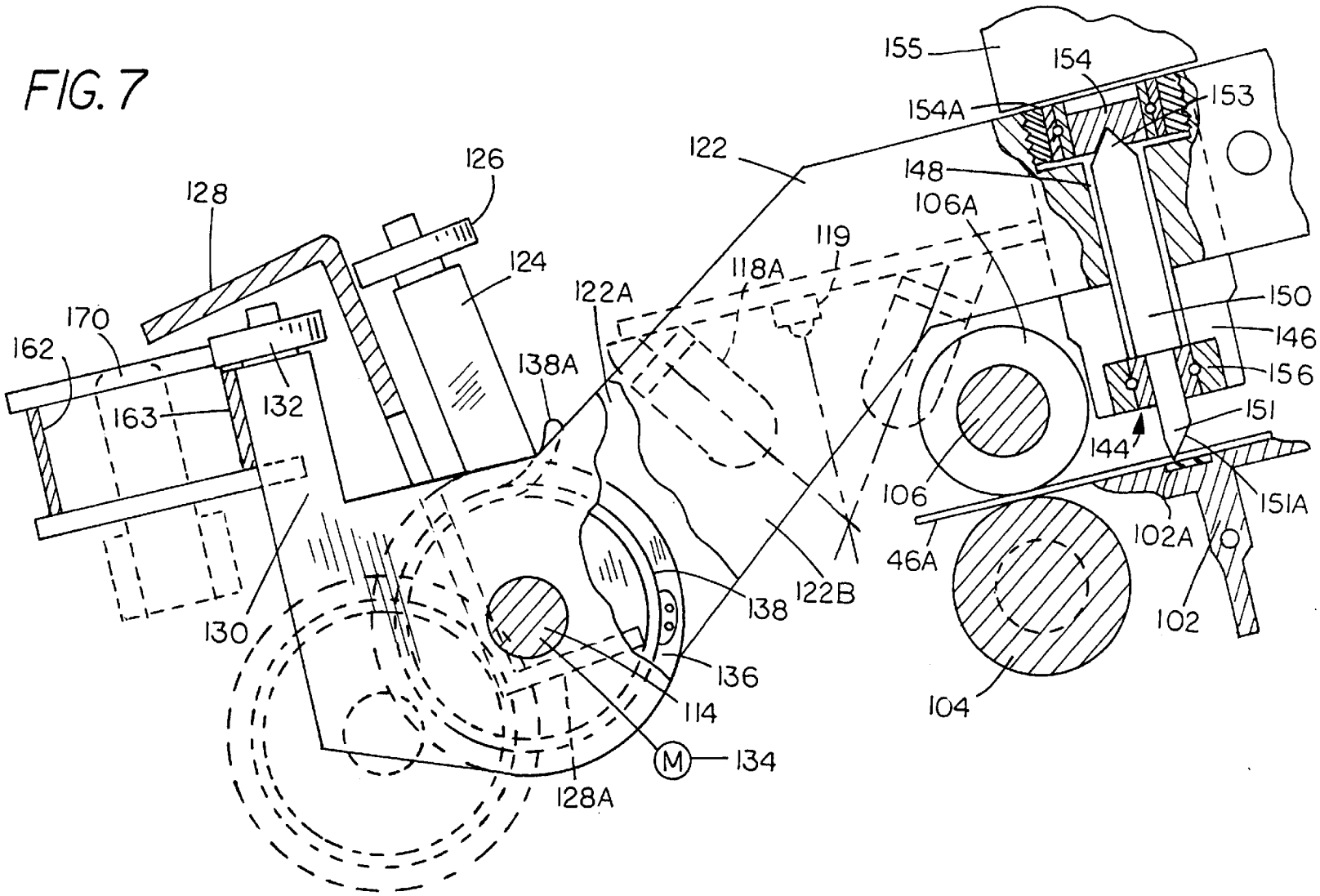
FIG. 7 is an enlarged side sectional view showing the cutter assembly and cutter assembly drive of the present invention.

The cutter assembly itself is shown perhaps in greatest detail in FIG. 7, as well as being shown in FIG. 4.

A cutter assembly 120 includes a mounting arm 122 which is rotatably mounted on the shaft 114. The arm 122 is formed to have two spaced walls 122A and 122B.

Figure 3:
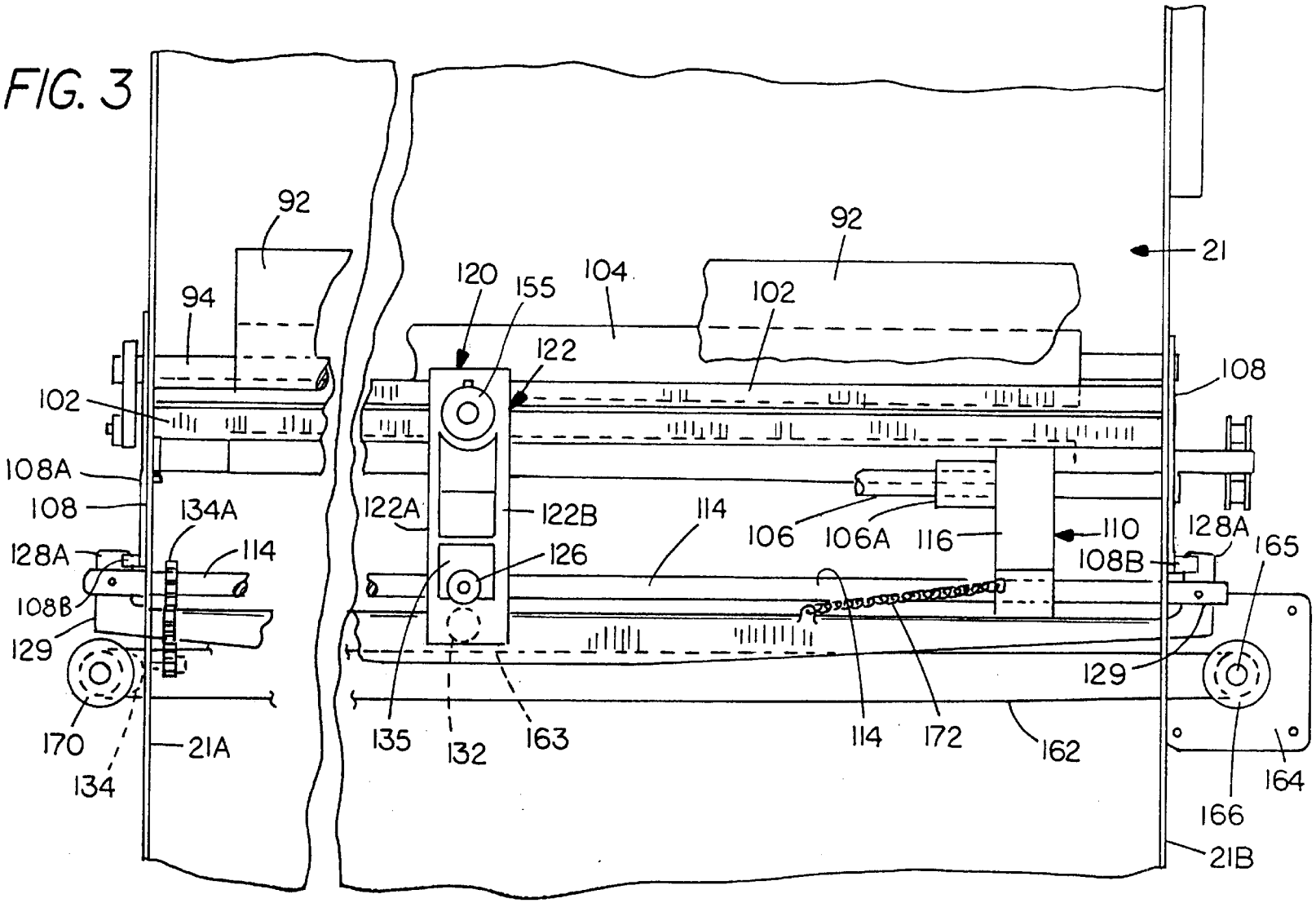
FIG. 3 is a top plan view of the cutter section of the label printer and cutter assembly.

The cutter arm 122 has an integral upwardly extending column 130 that has a wheel 132 rotatably mounted thereon about a generally upright axis. The wheel 132 will engage a back surface of a control plate or flange 128 which in turn has depending end leg section 129 drivably mounted to the ends of shaft 114 on the outside of the frame side plates 21A and 21B, as shown in FIG. 3. The column 130 forms a cutter arm lifter when the control plate 128 is moved in counter clockwise direction as shown in FIG. 7. The arm 122 is rotatably mounted on the shaft 114.

A cutter loading arm 124 is fixed to a hub 136 that is positioned between the two spaced apart side plates 122A and 122B of the arm assembly 122. Hub 136 carries torsion springs 138 that exert a bias force on the arm 122, so that when the control plate 128 is moved by driving the shaft 114 through a connected stepper motor 134 in clockwise direction (FIG. 7), the arm 124 will pivot hub 136 about the shaft 114. A separate torsion spring 138 is wrapped around each of the side portions of the hub as shown in FIG. 4. In turned first ends of the torsion spring are inserted in small bores so they are fixed to the hub 136. The opposite ends 138A of the torsion springs on each side of the hub 136, are looped over an edge of the adjacent side plates 122A and 122B of the arm 122. The torsion spring ends 138A fit over the side plates so that they exert a resilient force tending to rotate the arm 122 in a clockwise direction in FIG. 7. Since the control plate 128 is moved away from the wheel 132 when driven in clockwise direction, the control plate bears on wheel 126. The only loading of the cutter arm 122 in clockwise direction is through the torsion springs 138 as driven by arm 124 and hub 136.

When the arm 122 is to be raised, the control plate 128 will be moved by driving shaft 114 with a stepper motor 134 (through a gear set 134A) in opposite direction to engage the wheel 132 to provide a force in counter clockwise direction to move the column 130 in counter clockwise direction and lift the outer end of arm 122. The outer end of the arm 122 carries a knife assembly indicated at 144. The support hub for the knife assembly joins the side plates 122A and 122B and is fastened in place in a suitable manner. The knife assembly 144 includes a housing 146 which has a central bore 148 in which a rotatable knife shaft 150 having a knife end 151 is positioned. The shaft 150 has a conical end portion 153, seated in an inner race 154 of a bearing 154A. The outer race of bearing 154A is fixed in a cap 155 which is screwed into the top of housing 146. The opposite end of the housing 146 mounts a bearing 156 that supports the shaft 150 on a shoulder formed on the shaft. The knife can rotate freely about its longitudinal axis. As can be seen, the knife end 151 is tapered and has a sharpened edge 151A, in order to provide a lead in for cutting or slitting the sheet around the labels. The cutter knife end 151 is free to rotate to a position that is dictated by relative motion of the sheet. The cutter knife end 151 is aligned with the anvil member 102. The cutter can be actuated to position for engaging the sheet and making a slit that is of a substantially controlled depth (to cut the label and the backing sheet). The anvil 102 extends across the frame 21 and is supported on the frame side plates. A plastic insert 102A is provided directly below the knife.

The housing 146 can be held in place in the arm 122 in any suitable manner such as clamping the ends with a cross bolt.

The control plate 128 also serves as the actuator for lifting the cutter pinch roller 106. The control plate has the tabs 128A on the outer sides of each of the side plates 21A and 21B that project toward the cutter pinch roller 106 and align with but are spaced from the tabs 108B on arms 108 in normal use. The control plate 128 is actuable in counter clockwise direction, and can be rotated by stepper motor 134 sufficiently so tabs 128A engage tabs 108B to lift the end 108A of arms 108 to space the pinch roller 106 slightly from the index roller 104. The spacing permits the sheet orient itself as it is being loaded, or at another selected time.

The cutter knife can be lifted off the sheet being cut by the cutter assembly without lifting the pinch roller 106 since the actuator tabs 128A do not engage the tabs 108B until the control plate 128 has rotated a selected amount. The "lost motion" between the tabs 108B and 128A permits lifting the cutter knife or other implement without releasing the pinch roller.

As shown in FIG. 6, the plate 86 has portion 86A, and has a lip 86B that is used for supporting fans 200, the purpose of which will be explained. Upright end portions of a sheet rack 160 are positioned below fans 200. The sheet rack 160 is in position to receive the sheet from the cutter indexing roller 140 as the cuts are being made and to store finished cut sheets.

The cutter assembly can be moved axially along the shaft 114, which is in the lateral direction of the sheet. An endless belt 162, which can be a positive drive belt such as a cog belt, is drivably connected at 163 to the column 130 as shown schematically in FIG. 7. A stepper motor 164 having a substantially vertical shaft 165 is mounted on side plate 21B of the frame. The motor shaft 165 drives a pulley 166. The belt 162 is mounted around the pulley 166, and extends laterally across the frame 21 as shown in FIG. 3, and is mounted over an idler pulley 170 rotatably mounted on the opposite side of the frame 21. The pulleys 166 and 170 are flanged, as shown, to keep the belt 162 in proper position. Whenever the stepper motor 164 is driven, the belt 162 will move and will move the cutter assembly 120 laterally relative to the sheet along the shaft 117. This gives the "X" coordinate for the cuts to be made. The motor 164 is programmed to start and stop as needed for separating out the individual labels on the sheet that is being cut.

The lateral movement of the cutter assembly 120 is accommodated even when it is lifted by the wheel 132 riding against the surface of the control plate 128. Thus the cutter arm 122 can be held away from the sheet while it is moving laterally if desired, and also can be urged toward the sheet when the control plate 128 engages the wheel 126 and pivots the hub 136 to provide a spring pressure downwardly on the knife edge 151A.

The sensor arm 112 is urged laterally toward the cutter arm 122 by use of a tension spring 172, which hooks onto the arm 112 in a suitable manner, and also onto the control plate 128. The sensor arm 112 rides on the metal shaft of the pinch roller 106, and it will be stopped from lateral movement toward cutter arm 120 by a larger pinch roller section shown at 106A in FIG. 6. The pinch roller 106 has the larger diameter sections 106A that ride against the knurled part of the cutter indexing roller 104. In other words, the section that forms the pressure on the indexing roller 104 is of larger diameter than the metal shaft portion of roller 106, and form a shoulder that stops the movement of the sensor assembly 110 laterally under urging spring 172.

The sensor assembly 110 can be moved toward the side plate 21B on the right-hand side of the frame in order to sense the edge of the sheet by moving the cutter assembly 120, through operation of the stepper motor 164, laterally toward side plate 21B, against the spring pressure. The cutter assembly arm 122 and the sensor arm 112 are mounted on the same shaft 114 so that the hubs will engage and the sensor assembly 110 is then moved toward the adjacent side plate.

The sheet 46A is driven by the feed roller 88 and indexing roller 104. The pinch roller is lifted slightly when loading the sheet so the sheet can shift slightly. The front edge of the sheet is sensed by sensor 119, and the sheet length to the trailing or rear of the sheet can be calculated. Once the trailing edge of the sheet is clear of the print feed rollers the print feed rollers will stop. The controls for the motor 80 which drives indexing roller 104 have been provided the information of sheet length and the signal from sensor 119, so the index roller 104 will feed the desired sheet length without further sensor input.

The length of the sheet 46A is then fed by the cutter index roller 104 and feed roller 88 toward the tray or support 160. Using the sheet length information the index roller 104 is stopped with the sheet still held by the index roller 104 and aligned with the feed roller.

When the sheet rear edge has been advanced sufficiently, the stepper motor 80 and clutch operate to shift the scoop plate 66 and the guide hood 92 to their positions shown in solid lines in FIG. 6. The drive motor 80 for the indexing roller 104 is reversed after the diverter has shifted. The motor 80 will be rotating in the proper direction to operate the scoop plate when engaging the clutch for driving the shaft 82. This feeds the sheet 46A across the top of the feed roller 88 (which is also driven in reverse by the gear train) and the sheet will move on a plane approximately tangent to those two rollers 104 and 88 into a tray comprising a conventional rack or other support forming an eject tray 180 shown in FIG. 2.

The guide hood 92 is lifted far enough so that it will not interfere with moving the sheet 46A onto the eject tray 180 as the sheet is reversed. The spring 101 holds the hood 92 open when the clutch 72 is released.

The movement of the paper diverter scoop plate to its position in FIG. 6 permits the printer to print a separate sheet at a desired time. The sheet 46A which has the printed labels on it is fed back so that the sheet is fed away from the eject tray 180 toward the sensor 119 and the cutter, until the leading edge of the sheet is again sensed by sensor 119. Then the sheet is advanced until the horizontal target line 72A shown in FIG. 1A is also detected by the sensor 119 as the sheet moves. When that is sensed, the position is stored by the controls, and the sheet is advanced a short distance, and then the stepper motor 164 is energized to move the cutter arm 122 and thus the sensor arm 112 laterally toward the adjacent side plate 21B, until the sensor 119 detects the vertical or longitudinal line 72B and that information is sent to the controls. That gives the controls for the cutting operation a reference location, and it is known where the cuts should be made once this reference point has been determined because the target is indexed precisely to the printing that was carried out.

Then, the cutter index roller 104 will feed the material sheet 46A longitudinally and the cutter arm moves laterally. Through a combination of longitudinal and lateral motions the cutter can achieve any vector cut desired. Irregular shapes and shapes with cutouts inside the periphery of a label can be made. A single label also can be cut or worked on. The control plate 128 is controlled by the stepper motor operating the shaft 114 to provide a downward spring pressure on the knife, and intermittently raising the knife to go to a next label or during the sheet feeding process, as desired and appropriate.

The knife end 151 swivels easily, so that it can cut along the longitudinal or lateral lines easily, and the slits are controlled to go through the desired thickness of the sheet.

The indexing rollers 52 and 104 have small projections at opposite ends thereof that will form small recesses in the underside of the paper and provide for positive indexing as the sheet is fed back and forth.

The sheet will be reciprocated for the longitudinal cuts, and generally when a plurality of labels and printed, a row or "rank" of labels will be cut across the lateral dimension of the sheet 46A first, and then the sheet will be indexed longitudinally or in a column or "file" direction until the next row or rank of labels is in position for cutting.

As the cutting progresses the sheet is moved to storage tray 160, and when completed the sheet is left in the storage tray. The system provides a signal indicating that the cutting operation has been completed, so that the sheet that was being printed during the previous cutting operation can then be fed into the cutter by changing the position of the scoop plate 66 and the cutter feed roller hood 92 as previously explained. A pair of fans 200 of a relatively low flow rate are mounted to the frame 21 above the paper storage tray 160 and positioned under the sheet being cut, to provide a cushion of air that keeps the sheet being cut separated from sheets on the storage tray. When the labels are all cut on a sheet, the air cushion helps in preventing the sheet moving fully into the storage tray from catching on previous sheets and permits the new sheet to stack easier. The fan or fans 200 may be turned on and off by the controls if desired so as to be on only when needed, or they can be on whenever the unit is powered.

Figure 10:
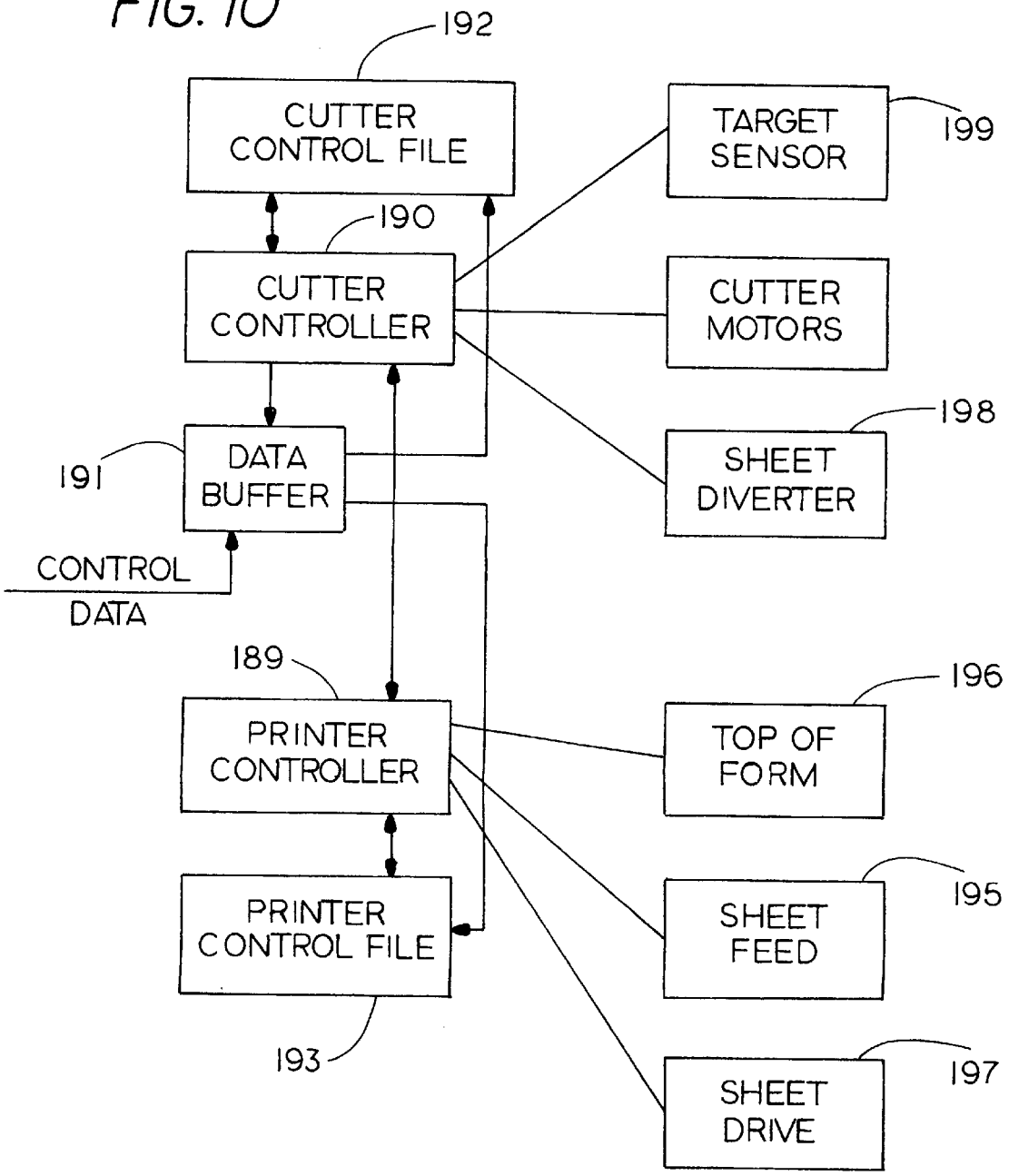
FIG. 10 is a simplified block diagram of controls used with the present invention.

FIG. 10 is a schematic block diagram representation of controls for the printer—cutter assembly. A pair of controllers are used for operating the system. A printer controller 189 and a cutter controller 190 are both connected to receive input data from a buffer 191. The buffer 191 receives the control data at an input. The cutter controller 190 also passes data to the cutter control file 192 or printer control file 193, as appropriate. Once the printer control file has been received, the printer controller 189 starts a sheet feed represented by block 195 to feed a sheet from the paper supply toward the platen, and to operate the sheet drive or feed rollers represented by block 197. The provided sensor senses the top of form at block 196 using the sensor described, and that signal is stored in memory. The sensor also provides a signal at the end of the sheet so the sheet length is calculated and also stored in memory for both the printer and cutter controllers.

The printing then continues under control of the printer controller 189 which controls the sheet drive and printer head in accordance with the program provided. When the print operation on a sheet is completed, a signal is received by the cutter controller 190. The cutter controller sets the sheet diverter comprising the scoop plate 66 and the guide hood 92, as represented by the block 198. The cutter controller 190 controls the cutter sheet feed and index rollers as explained. The front edge of the sheet is sensed and used to determine when the sheet is in the cutter indexing roller.

Once the trailing (rear) edge of the sheet is advanced to be on the cutter feed roller, a signal is sent to the cutter controller 190 and the cutter indexing roller operates to reverse the direction of sheet movement until the front edge of the sheet is sensed. This signal is used to indicate that the sensor is to sense the horizontal indexing line on the sheet and on the vertical line. When detected the position information is used for referencing the cutter control program for the cut vectors.

Then the cutter motors represented by block 206 are operated through the cutting steps under the control of the cutter controller 190 and the cutter sequence is carried out. After the step 198, when the sheet diverter is set to its initial position, the printer can operate through its steps of feeding another sheet, sensing the sheet length, printing the labels and providing the print complete signal.

After the cutter operation on the first sheet is completed, the cutter section receives the second printed sheet from the printer through the sheet transfer section and the cutting operation resumes.

A very compact assembly is formed for the label printer and secondary operation implement. The transfer section permits reliable operation of the compact unit.

Although the present invention has been described with reference to preferred embodiments, workers skilled in the art will recognize that changes may be made in form and detail without departing from the spirit and scope of the invention.

What is claimed is:

1. An apparatus for printing on a sheet performing a secondary operation on a section of the sheet at a known position relative to a reference, comprising:

a printer having a printing head and being controllable for feeding a printable sheet to the printing head for performing printing operations on the sheet;

a transfer section for receiving the printed sheet;

a secondary operation implement assembly positioned to receive the printed sheet from the transfer section including a sheet drive for reciprocally driving the sheet and having an implement for performing the secondary operation on at least a selected portion of the sheet after the sheet is received from the transfer section, and is reciprocally driven by the sheet drive; and a central control for controlling the printer, the transfer section and secondary operation implement assembly to sequentially print, transfer and perform the secondary operation on the sheet as controlled by the central control; and the central control including a secondary operation controller and a printer controller, the printer controller being operable to control the printer for printing a sheet during the time the secondary operation is being performed.

2. The apparatus of claim 1, wherein said printer has a printer indexing roller for moving a sheet relative to the printer head in forward and reverse directions, and wherein said transfer section comprises a sheet guide plate portion, said sheet guide plate having an end portion spaced from the print head for guiding a sheet being printed and moving in forward direction to a sheet support, and a shiftable scoop plate mounted independently and spaced from the printer head operable after the sheet has been printed for moving from a first position clearing sheets on the sheet guide plate portion to a second position adjacent to the end portion of the sheet guide plate portion and diverting a sheet being moved on the sheet guide plate portion by the printer indexing roller from moving onto the sheet support and transferring the sheet into the transfer section, said transfer section having guide surfaces for guiding the sheet as moved by the printer, indexing roller and scoop plates and a secondary feed roller associated with the secondary operation assembly mounted on the printer for receiving the sheet as the sheet is guided by the scoop plate, the scoop plate being operable to move to its first position after a first sheet has been received by the secondary feed roller, said printer controller being operable to operate the printer on a second sheet when the secondary operator is being performed.

3. The apparatus of claim 2, wherein said secondary feed roller comprises a secondary indexing roller to receive the printed sheet, and a sensor for sensing an indicia mark on the printed sheet for orienting the implement for performing the secondary operation.

4. The apparatus of claim 2, wherein the feed roller comprises an indexing roller for engaging a surface of the sheet opposite from a printed surface, and a spring loaded pinch roller engaging the printed surface for urging the sheet against the indexing roller, and an actuator for moving the pinch roller away from the indexing roller at selected times.

5. The apparatus of claim 1, wherein said secondary operation assembly is mounted for movement in direction along a surface of the sheet transversely of the sheet, and wherein the sheet is movable in a longitudinal direction relative to the implement permit the implement to engage the sheet for relative movement on two orthogonal coordinates on the sheet.

6. The apparatus of claim 1, wherein the implement is a cutter for cutting selected sections of the sheet.

7. The apparatus of claim 1, wherein said printer feeds the printable sheet past the printing head in a forward and a reverse direction during printing operations, the printer comprising a rotatable roller forming a platen, and the printing head operating to print on the sheet when the sheet is supported on the platen, a support for the printing head to lift the printing head when a sheet being printed is reversed, and a reverse sheet guide mounted on the apparatus and shiftable from a position wherein the reverse feed guide is adjacent to the platen and in a position to guide a sheet being fed in reverse when the print head is lifted from the platen, and moved to a position spaced from the platen when the print head is adjacent the platen.

8. The apparatus of claim 7, wherein said reverse sheet guide comprises a plate mounted on a pair of arms, said arms being pivotally mounted to the printer for permitting movement of the reverse sheet guide.

9. The apparatus of claim 8, wherein said arms are mounted on a shaft and said shaft is mounted for pivotal movement on the printer, a reversible drive motor, a slip clutch driven by the reversible drive motor and driving the shaft, and stop members for stopping the reverse sheet guide to position the reverse feed guide in selected stopped positions.

10. An apparatus for printing a plurality of individual sections of a sheet and cutting at least partially through the sheet around the sections, comprising:

a printer for printing the individual sections and having a sheet drive for moving the sheet along a sheet guide surface during printing at a printing portion and at the completion of printing;

a transfer section for receiving the sheet after printing, including a shiftable scoop plate positioned spaced from the printing position and movable from a first position clear of the sheet moving on the sheet guide surface to a second position adjacent to the sheet guide surface to divert a sheet being moved by the printer into the transfer section;

a cutter assembly positioned to receive the printed sheet from the transfer section and having a cutter member operable to cut the individual sections from the printed sheet; and a central control for controlling the printer, the transfer section and cutter assembly to sequentially print, transfer and cut the sheet as controlled by the central control; and the central control including a cutter assembly operation controller and a printer controller, the printer controller being operable to control the printer for printing a sheet during the time the cutter member is operable to cut a Previously printed sheet.

11. The apparatus of claim 10, wherein said printer has a printer indexing roller assembly for moving a sheet relative to a printer head, the indexing roller assembly driving the sheet toward the scoop plate and into the transfer section when the scoop plate is adjacent the sheet guide surface.

12. The apparatus of claim 10, wherein said cutter assembly includes a cutter feed roller to receive the printed sheet, and a sensor for sensing an indicia mark on the printed sheet for orienting the cutter member for cutting around peripheries of the individual sections.

13. The apparatus of claim 10, wherein the cutter assembly has a cutter feed roller adjacent the transfer section, a sheet guide hood adjacent the feed roller and movable from a first position away from the feed roller to a second position adjacent the feed roller and spaced from the feed roller along a length of the feed roller, the transfer section including guides to guide a sheet from the scoop plate into the space between the sheet guide hood and the feed roller with the sheet guide hood in its second position.

14. The apparatus of claim 13 and a drive between the scoop plate and the sheet guide hood to shift the sheet guide hood and scoop plate to the respective first and second positions at the same time.

15. A cutter assembly for cutting a sheet movable in longitudinal directions, including a cutter arm, a shaft mounted transversely of the sheet, said cutter arm being pivotally mounted on the shaft and mounted for movement along the shaft, and an independent biasing member, a spring coupling the independent biasing member to the cutter arm the independent biasing member exerting a biasing force on the cutter arm through the opening to urge an opposite end of the cutter arm toward a sheet to be cut, and a control plate mounted on the shaft, said control plate extending laterally of the sheet, said biasing member comprising a control arm having a roller that engages the control plate to roll along the control plate so the biasing member continues to exert a biasing force through said spring as controlled by an angular position of said control plate about the shaft.

16. The cutter assembly of claim 15, wherein said cutter arm has a column section positioned on an opposite side of said control plate from the control arm, and said column section having a wheel on an end thereof to permit engagement of the wheel with the opposite side of said control plate, whereby when said control plate angular position is changed in a second direction the control plate will lift the cutter arm to move the opposite end thereof away from the sheet.

17. An apparatus for printing on a sheet performing a secondary operation on a section of the sheet at a known position relative to a reference, comprising:

a printer having a printing head and being controllable for feeding a printable sheet to the printing head for performing printing operations on the sheet;

a transfer section for receiving the printed sheet;

a secondary operation implement assembly positioned to receive the printed sheet from the transfer section including a sheet drive for reciprocally driving the sheet and having an implement for performing the secondary operation on at least a selected portion of the sheet after the sheet is received from the transfer section, and is reciprocally driven by the sheet drive, said implement assembly including an implement arm for mounting the implement, a shaft on the apparatus pivotally mounting the implement, a shaft on the apparatus pivotally mounting the implement arm for movement about an axis, and an independent biasing member coupled to the implement arm, a spring mounted between the implement arm and the biasing member, the biasing member exerting a biasing force through the spring on the implement to urge the implement toward a sheet to be cut; and a control plate rotatably mounted on the apparatus about a control plate axis common with the pivot axis of said implement arm, said control plate extending laterally of the sheet, said biasing member comprising a control arm having a roller that engages the control plate and which permits lateral movement of the implement arm and the biasing member along the shaft mounting the implement arm while the roller moves along the control plate so the biasing member continues to exert a biasing force through said spring as controlled by an angular position of said control plate about the control plate axis.

18. The apparatus of claim 17, wherein said implement arm has a column section positioned on an opposite side of said control plate from the control arm and said column section having a wheel on an end thereof to permit engagement of the wheel with the opposite side of said control plate, whereby when said control plate angular portion is changed in a second direction the control plate will lift the implement arm to move the implement away from the sheet.

19. The apparatus of claim 18 and wherein the implement arm is mounted on a mounting shaft, and wherein a stepper motor is provided for controlling movement of said implement arm axially along the mounting shaft while permitting the biasing force to be exerted on the implement, an endless flexible member extending laterally substantially coextensively with the mounting shaft, said endless flexible member being coupled to the column section, said stepper motor driving said endless flexible member and moving the implement assembly laterally as the endless flexible member is moved by the stepper motor, said endless flexible member being sufficiently flexible to permit pivoting of said implement arm under control of said control plate.

* * * * *